US011326609B2

(12) United States Patent
Jancarik et al.

(10) Patent No.: US 11,326,609 B2
(45) Date of Patent: May 10, 2022

(54) CROSS FLOW BLOWER

(71) Applicant: Honeywell International Inc., Morris Plains, NJ (US)

(72) Inventors: Julius Jancarik, Brno (CZ); David Podola, Brno (CZ)

(73) Assignee: Honeywell International Inc., Morris Plains, NJ (US)

( * ) Notice: Subject to any disclaimer, the term of this patent is extended or adjusted under 35 U.S.C. 154(b) by 249 days.

(21) Appl. No.: 16/078,248

(22) PCT Filed: Feb. 29, 2016

(86) PCT No.: PCT/US2016/020005
§ 371 (c)(1),
(2) Date: Aug. 21, 2018

(87) PCT Pub. No.: WO2017/151085
PCT Pub. Date: Sep. 8, 2017

(65) Prior Publication Data
US 2019/0048879 A1 Feb. 14, 2019

(51) Int. Cl.
*F04D 17/16* (2006.01)
*A62B 7/10* (2006.01)
(Continued)

(52) U.S. Cl.
CPC ..... *F04D 17/16* (2013.01); *A62B 7/10* (2013.01); *A62B 9/00* (2013.01); *A62B 18/006* (2013.01);
(Continued)

(58) Field of Classification Search
CPC ..... F04D 17/00; F04D 17/06; F04D 17/04; F04D 17/16; F04D 29/22; F04D 29/28;
(Continued)

(56) References Cited

U.S. PATENT DOCUMENTS 1,456,195 A * 5/1923 Skidmore, Jr. ..... F04D 17/04 417/70
2,942,773 A 6/1960 Eck
(Continued)

FOREIGN PATENT DOCUMENTS

GB 0588088 A 5/1947
JP H05195981 A 8/1993
(Continued)

OTHER PUBLICATIONS

International Application No. PCT/US2016/020005, International Preliminary Report on Patentability, dated Sep. 4, 2018, 7 pages.
(Continued)

*Primary Examiner* — Justine R Yu
*Assistant Examiner* — Kelsey E Baller
(74) *Attorney, Agent, or Firm* — Alston & Bird LLP

(57) ABSTRACT

Embodiments relate generally to a cross flow blower (100) including a housing (108) which includes an inlet (104) and an outlet (102), rotating impeller blades (212) located within the housing (108), wherein airflow enters and exits the impeller blades (212) radially, a motor (106) operable to power the rotating impeller blades (212), and a plurality of flow forming blades (210, 214) located within the blower (100) operable to direct airflow within the blower (100).

17 Claims, 3 Drawing Sheets

(51) Int. Cl.

| | |
|---|---|
| ***A62B 9/00*** | (2006.01) |
| ***F04D 29/44*** | (2006.01) |
| ***A62B 18/00*** | (2006.01) |
| ***F04D 17/04*** | (2006.01) |

(52) U.S. Cl.
CPC ..... *F04D 17/04* (2013.01); *F04D 29/441* (2013.01); *F05D 2250/51* (2013.01)

(58) Field of Classification Search
CPC ..... F04D 29/281; F04D 29/44; A62B 18/006; A62B 7/10; A62B 9/00; A61M 16/0057; A61M 16/0066; F05D 2250/51
USPC ..... 128/205.12
See application file for complete search history.

(56) References Cited

U.S. PATENT DOCUMENTS 3,481,530 A * 12/1969 Korovkin ..... F04D 17/04 415/53.2
3,861,826 A * 1/1975 Dean, Jr. ..... F04D 29/444 415/208.4
4,231,702 A * 11/1980 Gopalakrishnan ..... F01D 1/14 415/143
4,430,995 A * 2/1984 Hilton ..... A61M 16/107 128/204.21
4,798,518 A * 1/1989 Holzberger ..... F04D 29/441 415/208.3
5,516,263 A * 5/1996 Nishida ..... F04D 29/444 415/208.2
8,118,025 B2 * 2/2012 Becker ..... A62B 18/006 128/201.22
8,277,168 B2 10/2012 Hardisty
8,591,170 B1 * 11/2013 Rawls ..... F03D 3/0463 415/4.2
2005/0210622 A1 * 9/2005 Baecke ..... F04D 29/4213 15/330
2006/0024160 A1 2/2006 Horng et al.
2006/0048782 A1 3/2006 Gossweiler
2008/0061559 A1 3/2008 Hirshberg
2010/0224190 A1 * 9/2010 Tilley ..... A62B 18/006 128/204.21
2012/0199129 A1 * 8/2012 Kenyon ..... F04D 29/4226 128/205.25
2013/0014752 A1 * 1/2013 Ausen ..... B01D 46/10 128/201.25
2013/0319408 A1 * 12/2013 Zwolinsky ..... A62B 18/006 128/202.22
2014/0261428 A1 * 9/2014 Chen ..... A62B 23/02 128/205.12
2015/0360060 A1 * 12/2015 Dehmke ..... A62B 7/10 128/201.25
2016/0030779 A1 * 2/2016 Twu ..... A62B 7/10 128/202.13
2016/0074683 A1 * 3/2016 Bergeron ..... A62B 18/08 128/201.19
2017/0002830 A1 * 1/2017 Bothma ..... F04D 29/663
2019/0105458 A1 * 4/2019 Hammes ..... F24F 13/20
2020/0182250 A1 * 6/2020 Kenyon ..... F04D 17/165

FOREIGN PATENT DOCUMENTS

WO 03023289 A1 3/2003
WO 2015030204 A1 3/2015
WO 2017151085 A1 9/2017

OTHER PUBLICATIONS

Europe Patent Application No. 16711923.9. Communication pursuant to Rules 161(1) and 162 EPC, dated Aug. 31, 2018, 3 pages.
Decision to Grant received for EP Application No. 16711923.9, dated Sep. 19, 2019, 2 pages.
Intention to Grant received for EP Application No. 16711923.9, dated May 14, 2019, 38 pages.
International Application No. PCT/US2016/020005, International Search Report, dated Nov. 23, 2016, 4 pages.
International Application No. PCT/US2016/020005, Written Opinion of the International Searching Authority, dated Nov. 23, 2016, 6 pages.

* cited by examiner

CROSS FLOW BLOWER

CROSS-REFERENCE TO RELATED APPLICATIONS

The present application is the National Stage of International Application No. PCT/US2016/020005 filed Feb. 29, 2016 and entitled "Thin Crossflow Blower With Stator Vanes For A Powered Air Purifying Respirator," which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In powered air respirators, as well as other industries, blowers may be used to provide breathable air to a user, to provide air to another situation, and/or to cool elements of a device. Blowers may be used in several different applications to provide powered air.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include a cross flow blower for use with a powered air respirator system. The cross flow blower may provide a slimmer profile (or decreased thickness) than typical blowers. This may be accomplished by using impeller blades within the blower, wherein the airflow enters and exits the impeller blades in a radial direction. The airflow within the blower may be directed by stationary flow forming blades located within the blower.

Workers wearing power air respirators may be required to work in confined or narrow spaces. Therefore, bulky equipment may inhibit the movement of the user while working in the confined or narrow space. By reducing the thickness (or width) of the blower worn by the worker, the overall profile of the worker's equipment may be reduced, preventing issues when the worker must enter a confined or narrow space.

Figure 1:
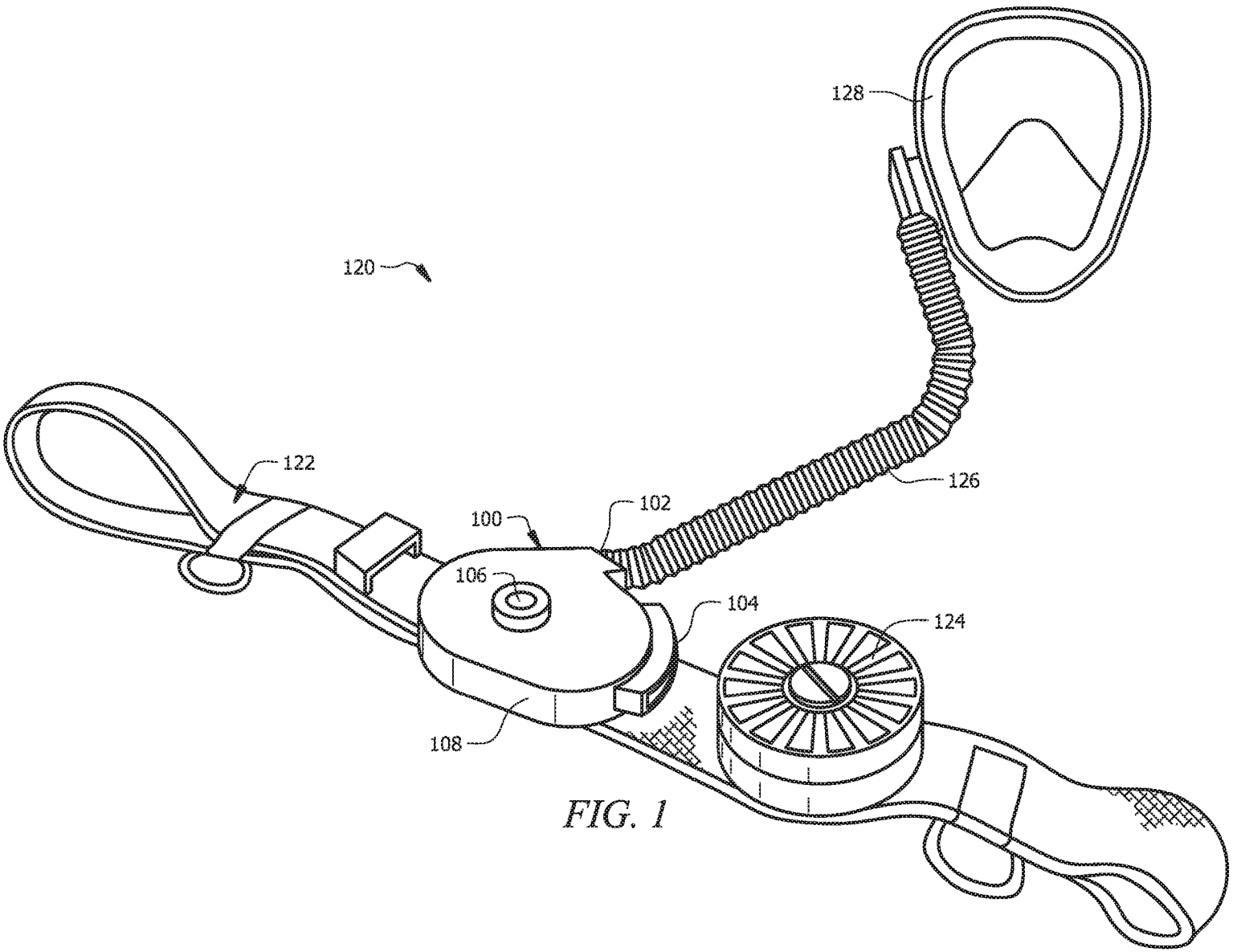
FIG. 1 illustrates a powered air respirator system according to an embodiment of the disclosure.

Referring now to FIG. 1, a blower 100 is shown. In some embodiments, the blower 100 may be incorporated into a powered air respirator system 120 that may be worn by a user. (A powered air respirator system may also be called a powered air purifying respirator (PAPR).) In some embodiments, the blower 100 may comprise an inlet 104 and an outlet 102. The blower 100 may comprise a motor 106 to power the blower 100. Also, the blower 100 may comprise a housing 108 operable to enclosure the elements of the blower 100.

In some embodiments, the blower 100 may be located on a belt system 122 of the power air respirator system 120. In some embodiments, the blower 100 may be located on a jacket worn by the user. In some embodiments, the blower 100 may receive filtered air from one or more filter 124, which may be attached to the inlet 104, for example via a hose (not shown). In some embodiments, the blower 100 may comprise an adapter operable to connect the inlet 104 to a hose or other connector. In some embodiments, the blower 100 may direct the filtered air via the outlet 102 to a hose 126. In some embodiments, the blower 100 may comprise an adapter operable to connect the outlet 102 to the hose 126 or other connector. Additionally, the outlet 102 may be in fluid communication (via the hose 126) with the interior of a facepiece 128, such as a hood and/or mask, worn by a user. In some embodiments, the blower 100 may comprise a plastic material.

Although the blower 100 is shown in use with a power air respirator system 120, those skilled in the art may understand that a similar blower 100 with a decreased profile (or thickness) may be used in other applications, such as in computer, tablets, and/or mobile devices, wherein the blower 100 may be used to cool the elements of the devices.

The decreased thickness of the blower 100 may be useful in small spaces, such as those within computers and mobile devices.

Figure 2:
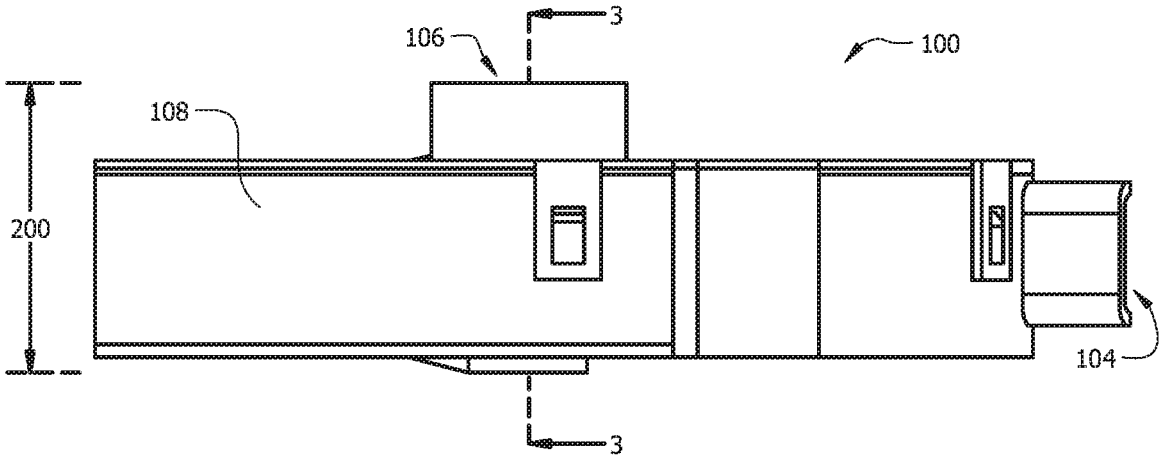
FIG. 2 illustrates a side view of a cross flow blower according to an embodiment of the disclosure.

Referring now to FIG. 2, a side view of the blower 100 is shown. In the view shown in FIG. 2, the outlet 102 (not shown) may be located on the backside of the blower 100. The housing 108 may be shaped to enclose the other elements of the blower 100. In some embodiments, the blower 100 may comprise a height 200 (or thickness) of less than approximately 2 inches. In some embodiments, the blower 100 may comprise a height 200 of between approximately 1 to 1.5 inches. In some embodiments, the blower 100 may comprise a height 200 of approximately 35 millimeters.

Figure 3:
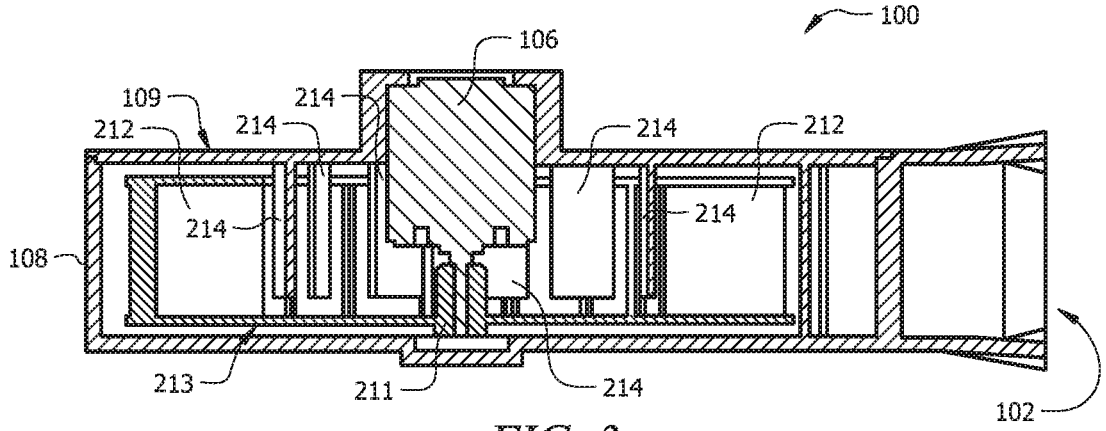
FIG. 3 illustrates a cross-section view of a cross flow blower according to an embodiment of the disclosure.

Referring now to FIG. 3, a cross-sectional view of the blower 100 is shown, wherein the view in FIG. 3 is indicated by the dashed line in FIG. 2. From the view in FIG. 3, the outlet 102 may be shown. The housing 108 may comprise a top portion 109 operable to fit over the motor 106. In some embodiments, the top portion 109 may be shaped to fit over the motor 106 of the blower 100.

In some embodiments, the top portion 109 may be attached to one or more flow forming blades located within the blower 100. In some embodiments, the flow forming blades may be molded to the top portion 109. In some embodiments, the flow forming blades may be stationary within the blower 100. In some embodiments, the blower 100 may comprise central flow forming blades 214 located near the center of the blower 100. In some embodiments, the blower 100 may also comprise inlet flow forming blades (not shown).

In some embodiments, the blower 100 may comprise impeller blades 212, wherein the impeller blades 212 may be controlled by the motor 106. In some embodiments, the impeller blades 212 may be connected to one another via a frame 213, wherein the frame 213 may comprise a connector 211 operable to attach to the motor 106. The frame 213 may connect the impeller blades 212 while allowing air to flow through the impeller blades 212. In some embodiments, the frame 213 may comprise top and bottom portions.

Figure 4:
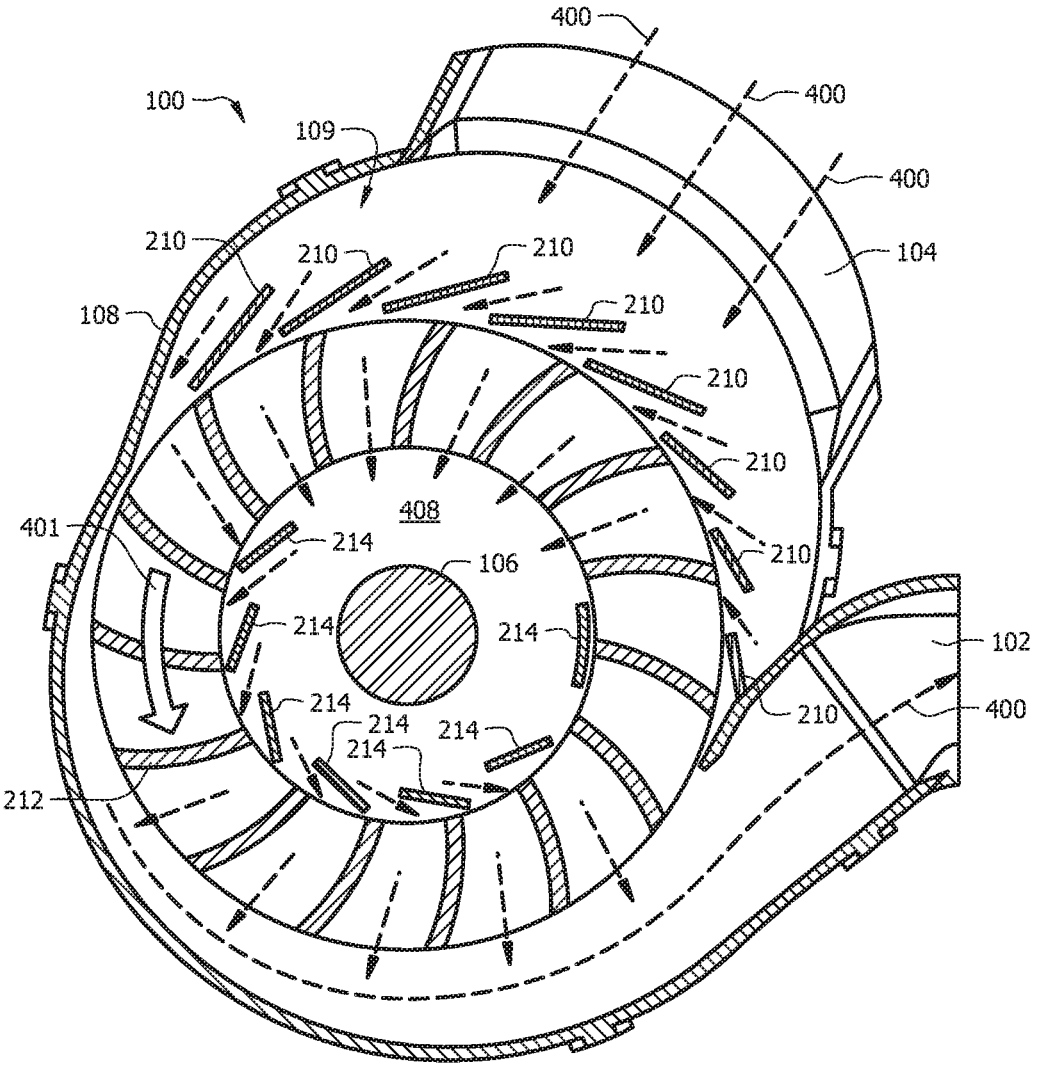
FIG. 4 illustrates another cross-section view of a cross flow blower according to an embodiment of the disclosure.

Referring now to FIG. 4, a horizontal cross-sectional view of the blower 100 is shown. The view in FIG. 4 is of the top portion of the blower 100. The dashed arrows 400 show approximate anticipated airflow paths through the blower 100. As shown in FIG. 4, the inlet 104 of the blower 100 may comprise a wide opening to allow for increased airflow into the blower 100. The motor 106 may control the impeller blades 212 (as described above). In some embodiments, the airflow 400 may enter and exit the impeller blades 212 radially (as indicated by the arrows).

In some embodiments, the blower 100 may be operable to displace a similar air volume as typical air blowers used in the market. However, because the thickness of the blower 100 has been decreased, the width of the inlet 104, and possibly other elements of the blower 100, may be increased. To ensure that the airflow 400 through the blower 100 is efficient, flow forming blades 210 and 214 may be placed within the blower 100.

In some embodiments, the blower 100 may comprise inlet flow forming blades 210 operable to direct airflow from the inlet 104 into the impeller blades 212. The inlet flow forming blades 210 may also be operable to block any airflow from leaving the impeller blades 212 back toward the inlet 104. The inlet flow forming blades 210 may be positioned to direct the airflow into the impeller blades 212, wherein the shape, length, angle, and spacing of the inlet flow forming blades 210 may be chosen to best direct the airflow 400. In some embodiments, the inlet flow forming blades 210 may be attached to (or incorporated into) the top portion 109 of the housing 108.

In the embodiment of FIG. 4, the impeller blades 212 may rotate in the direction indicated by arrow 401. As the impeller blades 212 rotate, centrifugal effects may push the air out of the blades 212 (radially). Additionally, the rotating impeller blades 212 may cause a backpressure or vacuum, drawing air into the blower 100 via the inlet 104. As the air is directed into the impeller blades 212 by the inlet flow forming blades 210, the airflow 400 may pass through the impeller blades 212 into the center of the blower 100. The impeller blades 212 may form a circular center portion 408 of the blower 100. Within the center portion 408, the blower 100 may comprise a plurality of central flow forming blades 214. The central flow forming blades 214 may direct the airflow through the center portion 408 of the blower 100 toward the outlet 102 of the blower 100. The central flow forming blades 214 may also be operable to block any airflow from leaving the impeller blades 212 back toward the center portion 408.

The central flow forming blades 214 may be positioned to direct the airflow into the impeller blades 212 toward the outlet 102, wherein the shape, length, angle, and spacing of the central flow forming blades 214 may be chosen to best direct the airflow 400. In some embodiments, the central flow forming blades 214 may be attached to (or incorporated into) the top portion 109 of the housing 108. Once the airflow 400 is directed out of the center portion 408 through the impeller blades 212, the airflow 400 may be directed toward the outlet 102, wherein the outlet 102 may be connected to the interior of a hood and/or mask worn by a user.

The inlet flow forming blades 210 and the central flow forming blades 214, and possibly other types of flow forming blades located within the blower, may improve the efficiency of the blower 100, and allow for a thinner profile for the blower 100. The thinner profile for the blower 100 may allow the blower 100 to be worn by a user in confined or tight work spaces.

Embodiments of the disclosure may comprise a cross flow blower comprising a housing comprising an inlet and an outlet; rotating impeller blades located within the housing, wherein airflow enters and exits the impeller blades radially; a motor operable to power the rotating impeller blades; and a plurality of flow forming blades located within the blower operable to direct airflow within the blower.

In some embodiments, the thickness of the housing may be less than approximately 2 inches. In some embodiments, the thickness of the housing may be between approximately 1 and 1.5 inches. In some embodiments, the thickness of the housing may be approximately 35 millimeters. In some embodiments, the flow forming blades may comprise inlet flow forming blades located between the inlet and the impeller blades, wherein the inlet flow forming blades may be operable to direct airflow from the inlet into the impeller blades. In some embodiments, the flow forming blades may comprise central flow forming blades located within a central portion of the impeller blades, wherein the central flow forming blades may be operable to direct airflow through the impeller blades toward the outlet. In some embodiments, the flow forming blades may be attached to the housing. In some embodiments, the flow forming blades may be molded to a top portion of the housing. In some embodiments, the inlet of the blower may be operable to attach to one or more filter, such that the air that flows through the blower is first passed through the filter. In some embodiments, the outlet of the blower may be in fluid communication with a hood or mask worn by a user. In some embodiments, the cross flow blower may be part of a powered air respirator system. In some embodiments, the air may cross through the impeller blades twice before exiting the blower.

Other embodiments of the disclosure relate to powered air respirator systems that may comprise a facepiece operable to fit onto or over a user's head; one or more filter operable to filter air to be breathed by the user; and a cross flow blower operable to supply filtered air to the facepiece, wherein the cross flow blower may comprise a housing comprising an inlet and an outlet, wherein the thickness of the housing is less than approximately 2 inches; rotating impeller blades located within the housing; a motor operable to power the rotating impeller blades; and a plurality of flow forming blades located within the blower operable to direct airflow within the blower.

In some embodiments, the air may cross through the impeller blades twice before exiting the blower. In some embodiments, the airflow may enter and exit the impeller blades radially. In some embodiments, the flow forming blades may comprise inlet flow forming blades located between the inlet and the impeller blades, wherein the inlet flow forming blades may be operable to direct airflow from the inlet into the impeller blades. In some embodiments, the flow forming blades may comprise central flow forming blades located within a central portion of the impeller blades, wherein the central flow forming blades may be operable to direct airflow through the impeller blades toward the outlet. In some embodiments, the powered air respirator system may further comprise a belt worn by the user, wherein the cross flow blower is attached to the belt. In some embodiments, the flow forming blades may be attached to the housing.

Embodiments of the disclosure may also include a cross flow blower comprising a housing comprising an inlet and an outlet; rotating impeller blades located within the housing, wherein airflow enters and exits the impeller blades radially, and wherein the impeller blades form a circular central portion; a motor operable to power the rotating impeller blades; a plurality of inlet flow forming blades located between the inlet and the impeller blades, operable to direct airflow from the inlet into the impeller blades located within the blower; and a plurality of central flow forming blades located within the central portion of the impeller blades, operable to direct airflow through the impeller blades toward the outlet.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A powered air respirator system comprising:

a facepiece operable to fit onto or over a user's head;

one or more filter operable to filter air to be breathed by the user; and a cross flow blower operable to supply filtered air to the facepiece, wherein the cross flow blower comprises:

a housing comprising an inlet and an outlet;

rotating impeller blades located within the housing;

a motor operable to power the rotating impeller blades, the motor located within a central portion of the rotating impeller blades; and a plurality of flow forming blades located within the cross flow blower operable to direct airflow within the cross flow blower, wherein the plurality of flow forming blades comprises:

inlet flow forming blades arranged across the inlet to be substantially tangent to a rotational direction of the rotating impeller blades; and central flow forming blades located circumferentially around the motor within the central portion of the rotating impeller blades, and wherein the central flow forming blades are positioned at an angle with respect to the rotating impeller blades such that the central flow forming blades block any airflow from leaving the rotating impeller blades back toward the central portion.

2. The powered air respirator system of claim 1, wherein the airflow crosses through the impeller blades twice before exiting the cross flow blower.

3. The powered air respirator system of claim 1, wherein the airflow enters and exits the impeller blades radially.

4. The powered air respirator system of claim 1, wherein the inlet flow forming blades are located between the inlet and the impeller blades, and wherein the inlet flow forming blades are operable to direct airflow from the inlet into the impeller blades.

5. The powered air respirator system of claim 4, wherein the inlet flow forming blades are operable to block any airflow from leaving the impeller blades back toward the inlet.

6. The powered air respirator system of claim 1, wherein the central flow forming blades are operable to direct airflow through the impeller blades toward the outlet.

7. The powered air respirator system of claim 1, further comprising a belt worn by the user, wherein the cross flow blower is attached to the belt.

8. The powered air respirator system of claim 1, wherein the flow forming blades are attached to the housing.

9. A cross flow blower comprising:

a housing comprising an inlet and an outlet;

rotating impeller blades located within the housing, wherein airflow enters and exits the impeller blades radially;

a motor operable to power the rotating impeller blades, the motor located within a central portion of the rotating impeller blades; and a plurality of flow forming blades located within the cross flow blower operable to direct airflow within the cross flow blower, wherein the flow forming blades comprise inlet flow forming blades located between the inlet and the impeller blades;

wherein the inlet flow forming blades are operable to direct airflow from the inlet into the impeller blades and operable to block airflow from leaving the impeller blades back toward the inlet, wherein the inlet flow forming blades are arranged across the inlet to be substantially tangent to a rotational direction of the rotating impeller blades;

wherein the flow forming blades comprise central flow forming blades located circumferentially around the motor within the central portion of the impeller blades; and wherein the central flow forming blades are positioned at an angle with respect to the rotating impeller blades to direct airflow through the impeller blades toward the outlet and to block airflow from leaving the impeller blades back toward the central portion.

10. The cross flow blower of claim 9, wherein the thickness of the housing is approximately 35 millimeters.

11. The cross flow blower of claim 9, wherein the inlet flow forming blades are attached to the housing.

12. The cross flow blower of claim 9, wherein the flow forming blades are molded to a top portion of the housing.

13. The cross flow blower of claim 9, wherein the inlet of the cross flow blower is operable to attach to one or more filter, such that the air that flows through the cross flow blower is first passed through the one or more filter.

14. The cross flow blower of claim 9, wherein the outlet of the cross flow blower is in fluid communication with a hood or mask worn by a user.

15. The cross flow blower of claim 9, wherein the cross flow blower is part of a powered air respirator system.

16. The cross flow blower of claim 9, wherein the airflow crosses through the impeller blades twice before exiting the cross flow blower.

17. A cross flow blower comprising:

a housing comprising an inlet and an outlet;

rotating impeller blades located within the housing, wherein airflow enters and exits the impeller blades radially, and wherein the rotating impeller blades form a circular central portion;

a motor operable to power the rotating impeller blades, the motor located within the circular central portion of the rotating impeller blades;

a plurality of inlet flow forming blades located between the inlet and the impeller blades, operable to direct airflow from the inlet into the impeller blades located within the cross flow blower; and a plurality of central flow forming blades located circumferentially around the motor within the circular central portion of the impeller blades, the plurality of central flow forming blades operable to direct airflow through the impeller blades toward the outlet, wherein the plurality of inlet flow forming blades are arranged across the inlet to be substantially tangent to a rotational direction of the rotating impeller blades; and wherein the central flow forming blades are positioned at an angle with respect to the rotating impeller blades such that the central flow forming blades block any airflow from leaving the rotating impeller blades back toward the circular central portion.

* * * * *